US005880654A

United States Patent [19]

Yamaguchi et al.

[11] Patent Number: 5,880,654

[45] Date of Patent: Mar. 9, 1999

[54] ELECTROMAGNETIC RELAY

[75] Inventors: Tatsunori Yamaguchi; Takashi Noguchi, both of Kyoto, Japan

[73] Assignee: Omron Corporation, Kyoto, Japan

[21] Appl. No.: 863,784

[22] Filed: May 27, 1997

[30] Foreign Application Priority Data

May 27, 1996 [JP] Japan ..... 8-131797
May 27, 1996 [JP] Japan ..... 8-131809

[51] Int. Cl.[6] ..... H01H 51/22

[52] U.S. Cl. ..... 335/78; 335/80; 335/124

[58] Field of Search ..... 335/78–86, 124, 335/128, 129, 130, 131, 132, 133, 134, 135

[56] References Cited

U.S. PATENT DOCUMENTS 5,539,364 7/1996 Mader ..... 335/130

*Primary Examiner*—Lincoln Donovan
*Attorney, Agent, or Firm*—Morrison & Foerster

[57] ABSTRACT

An electromagnetic relay comprising a smaller number of components and would be shorter than its predecessors. A movable block and a contact mechanism in a conventional relay are arrayed in a linear fashion, which tends to increase the length of the relay. This relay, however, has a movable block placed on a electromagnetic block, and a drive rod extending from the movable block drives a contact mechanism which is installed on one side of the electromagnetic block to short the length of the relay.

13 Claims, 16 Drawing Sheets

ELECTROMAGNETIC RELAY

FIELD OF THE INVENTION

This invention concerns an electromagnetic relay, and more specifically, the drive mechanism which makes and breaks the contacts of the relay.

BACKGROUND OF THE INVENTION

An example of an electromagnetic relay belonging to the prior art is shown in FIG. 16. This relay comprises electromagnetic block 1, which is formed by wrapping coil 1*c* around two facing L-shaped cores, 1*a* and 1*b*; H-electrode 2*b*, which rotates shaft 2*a* on its axis in response to the presence or absence of excitation in electromagnetic block 1; transmission mechanism 3, which travels back and forth with the rotation of H electrode 2*b*; and contact mechanism 6, in which the movement of transmission mechanism 3 causes movable contacts 4*a* on members 4 to come in contact with or move away from fixed contacts 5*a* on members 5.

7 is a spring mounted on support 8 to return mechanism 3 to its original position.

In the electromagnetic relay which we have been discussing, contact mechanism 6 is driven by H electrode 2*b* and transmission mechanism 3, a scheme which requires a large number of components. This entails a large number of assembly processes and increases the likelihood that the precision with which the components are assembled, and hence the operating characteristics, will vary.

Also, in this relay electromagnetic block 1, H electrode 2*b* and contact mechanism 6 are arrayed in a linear fashion, which tends to increase the length of the relay. Since the length of contact mechanism 6 will increase with the number of circuits, it will be impossible to produce a short electromagnetic relay if there are a large number of circuits to make and break.

SUMMARY OF THE INVENTION

The objective of this invention is to provide an electromagnetic relay with fewer components so that it can be made shorter.

In the relay described above, H electrode and transmission mechanism are discrete components which are not assembled as a single piece and do not operate as a single component. For this reason they are liable to vary in assembly precision and operating characteristics, which will adversely affect the repeatability of their response.

In light of these difficulties, another objective of this invention is to provide an electromagnetic relay whose assembly precision and operating characteristics will not vary and which will have a good response characteristic.

In order to achieve the objectives outlined above, the electromagnetic relay of this invention is as follows. It comprises an electromagnetic block formed by wrapping a coil around an iron core; a movable block having a member which sits atop the electromagnetic block and moves parallel to the axis of the aforesaid core in response to the presence or absence of excitation in the aforesaid electromagnetic block; and contact mechanisms on one or either side of the aforesaid electromagnetic block which can be driven by the aforesaid movable block.

The aforesaid electromagnetic and movable blocks should be enclosed in a box-shaped base block comprising two bases on whose exteriors are mounted the aforesaid contact mechanisms. The aforesaid bases should be identical in shape. The positions of the aforesaid electromagnetic and movable blocks should be adjustable within the aforesaid box-shaped base block in the axial direction of the aforesaid core so that the operating characteristics of the aforesaid contact mechanisms can be adjusted.

The aforesaid contact mechanism comprises a number of pairs of movable and fixed contacts fitted into grooves in the exterior walls of the aforesaid box-shaped base. These contacts should act as partitions which touch the interior walls of the cover fitted onto the aforesaid base so that the walls are partitioned by each set of movable and fixed contacts.

On the interior walls of the aforesaid cover there should be ribs which adjoin the aforesaid partitions.

The aforesaid movable block engages with a member which is mounted on a card from which at least one drive rod protrudes to one side to drive the aforesaid contact mechanisms.

The aforesaid movable block should comprise a permanent magnet sandwiched between two movable iron members.

Two cut-away portions on the side of the aforesaid lower member should engage with two bosses on the internal surface of the aforesaid card.

The aforesaid permanent magnet should engage between a pair of bosses on the internal surface of the aforesaid card.

The cut-away portions on the movable member on the upper end of the magnet should engage with tangs extending upward from the upper edge of the aforesaid card.

Alternatively, the aforesaid movable block may be supported by two springs which engage with the ends of the card in such a way that the block is free to move back and forth in a course which is parallel to the axis of the aforesaid core.

The exterior front edges of the card which come in contact with the inward-facing surfaces of the aforesaid supporting springs may be different distances from the center line of the card.

BRIEF DESCRIPTION OF THE INVENTION

Figure 6A:
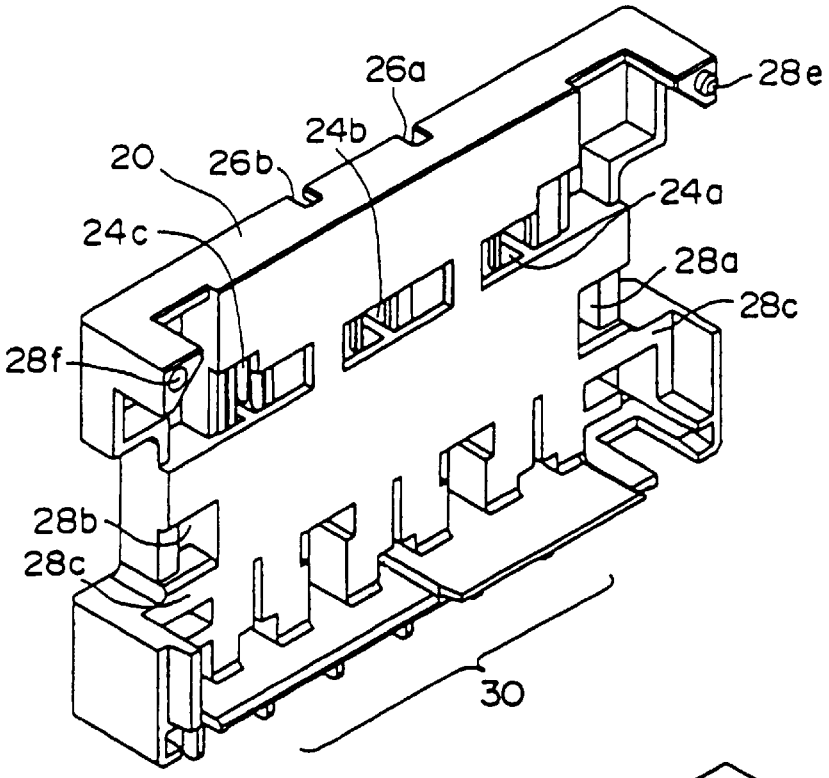
Figure 6B:
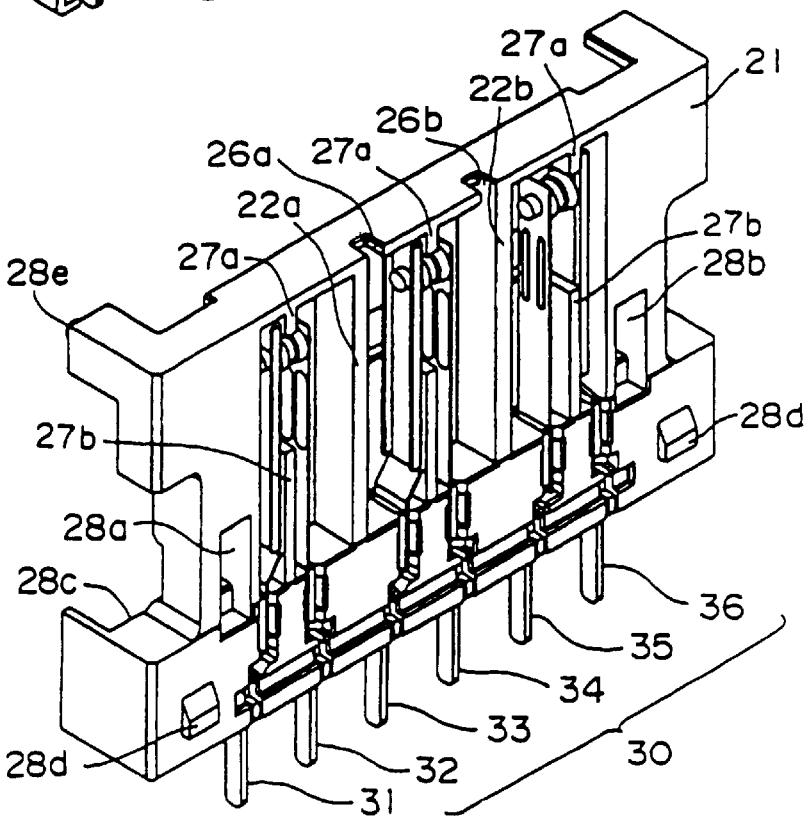

FIGS. 6*a* and 6*b* are a magnified perspective drawings of the base units which comprise the base block.

Figure 7:
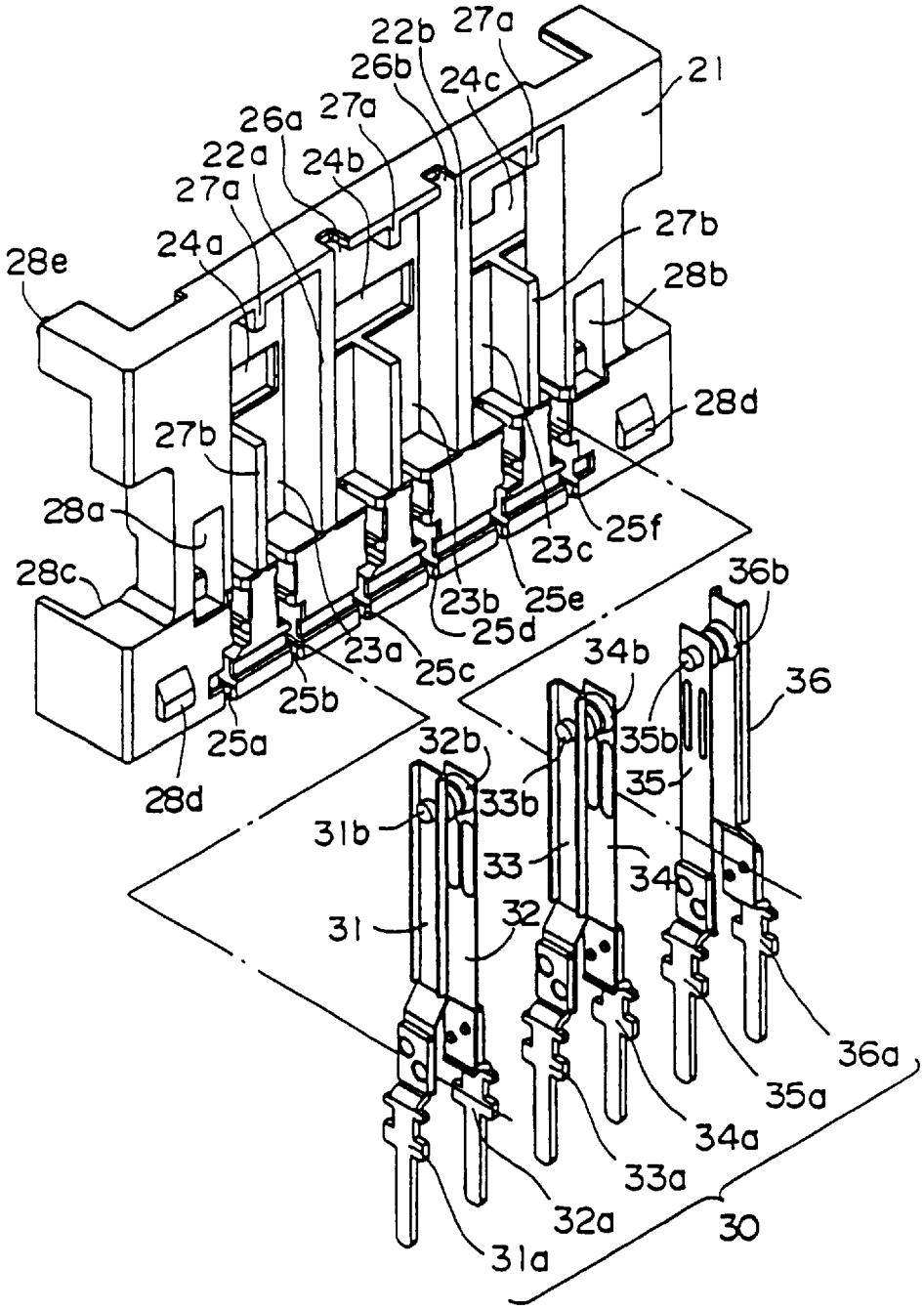

FIG. 7 is an exploded perspective drawing showing how the contact mechanisms are installed in the base.

Figure 8A:
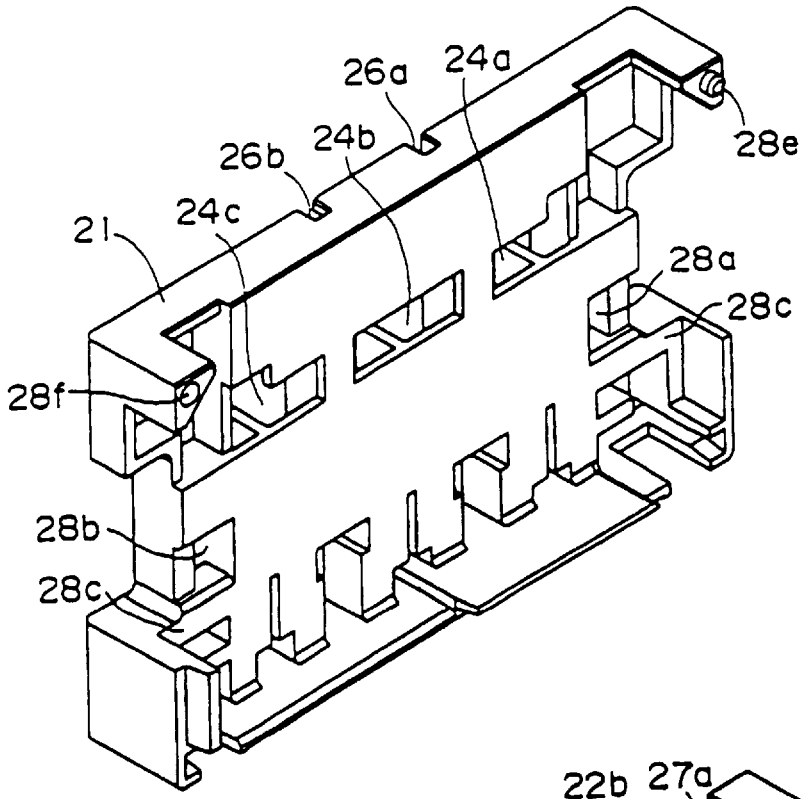
Figure 8B:
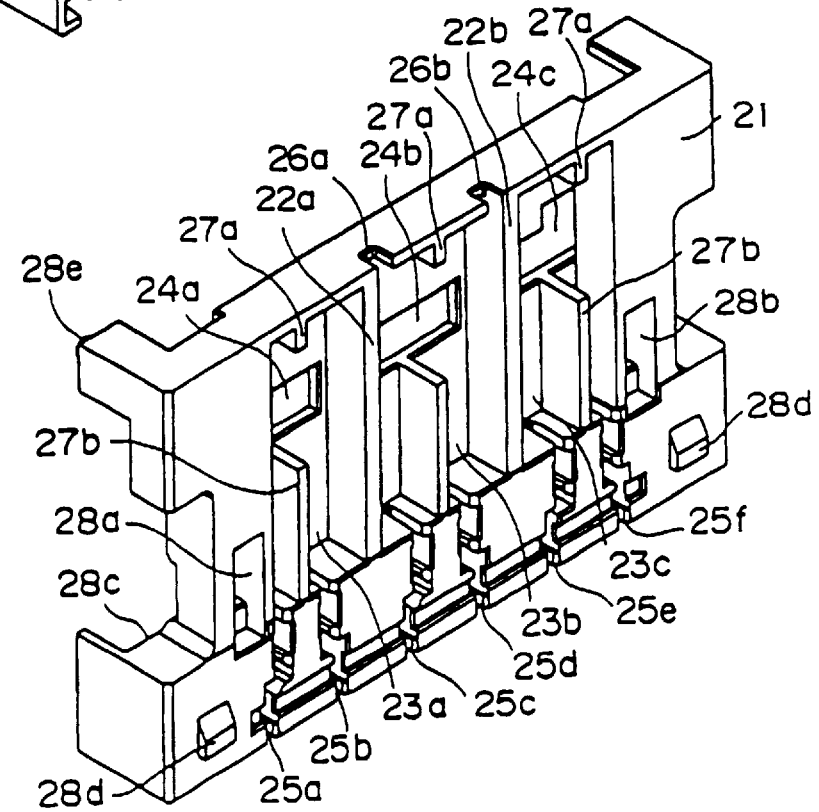

FIGS. 8*a* and 8*b* show one of the base units. (a) is a perspective drawing of the unit viewed from within; (b) is a drawing of the same unit viewed from without.

Figure 9:
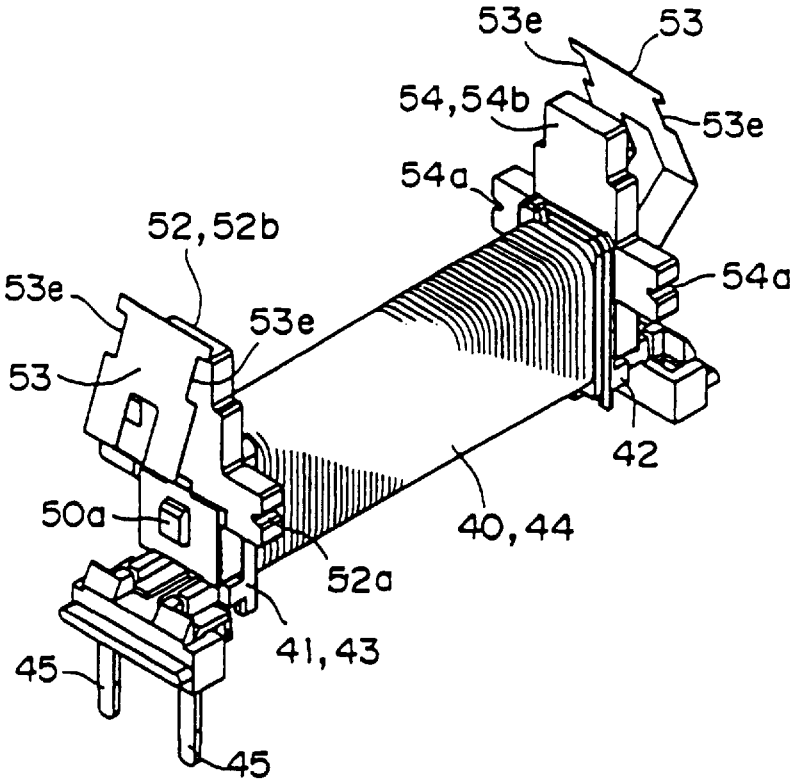

FIG. 9 is a perspective drawing of the electromagnetic block.

Figure 10:
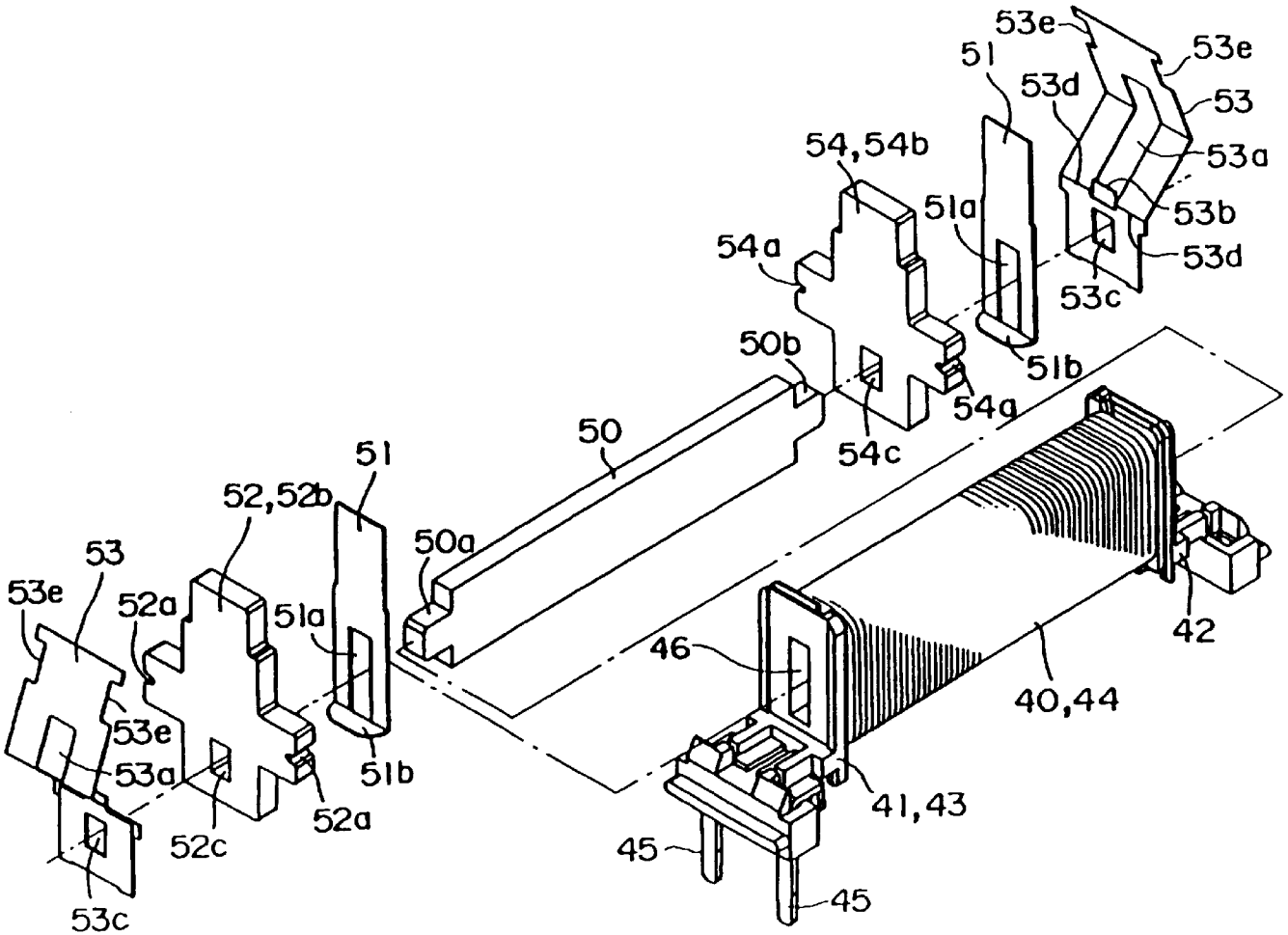
Figure 11A:
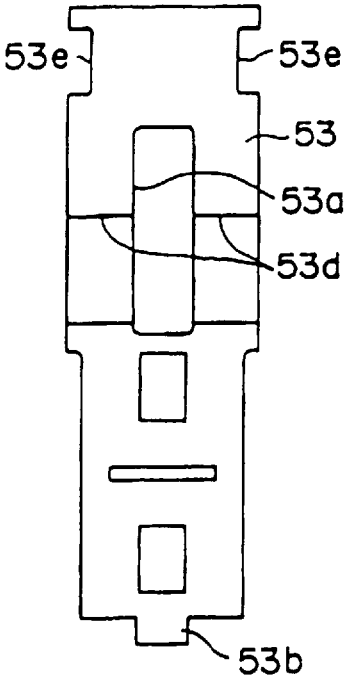
Figure 11E:
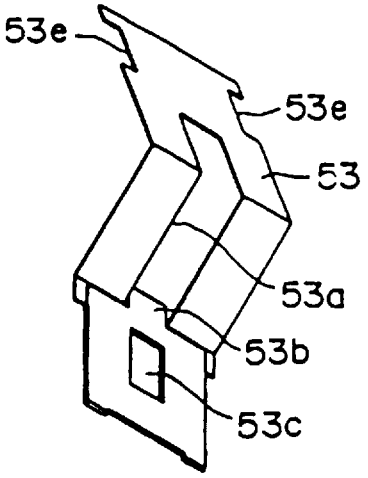
Figure 11B:
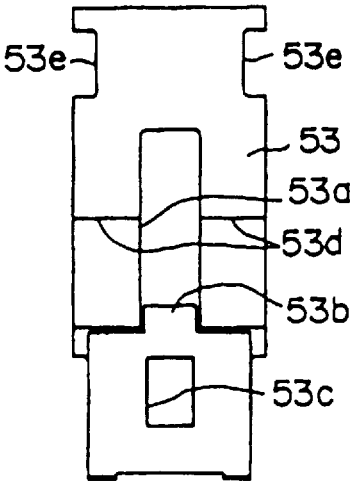
Figure 11C:
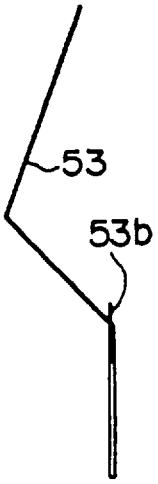
Figure 11D:
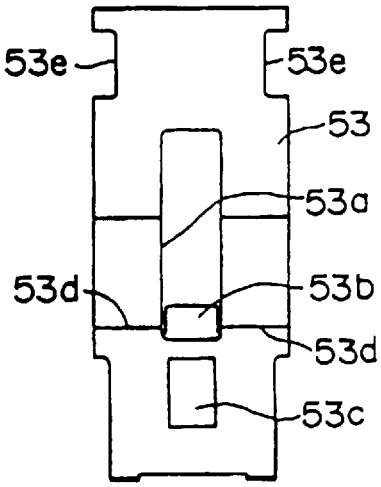

FIG. 10 is an exploded perspective drawing of the electromagnetic block.

FIG. 11*a*–11*e* show one of the support springs pictured in FIG. 10. (a) is a frontal view of the spring before it is bent. (b) is a frontal view of the spring after it is bent. (c) is a view from the left side. (d) is a view from the rear. (e) is a perspective drawing of the spring viewed from below.

Figure 12:
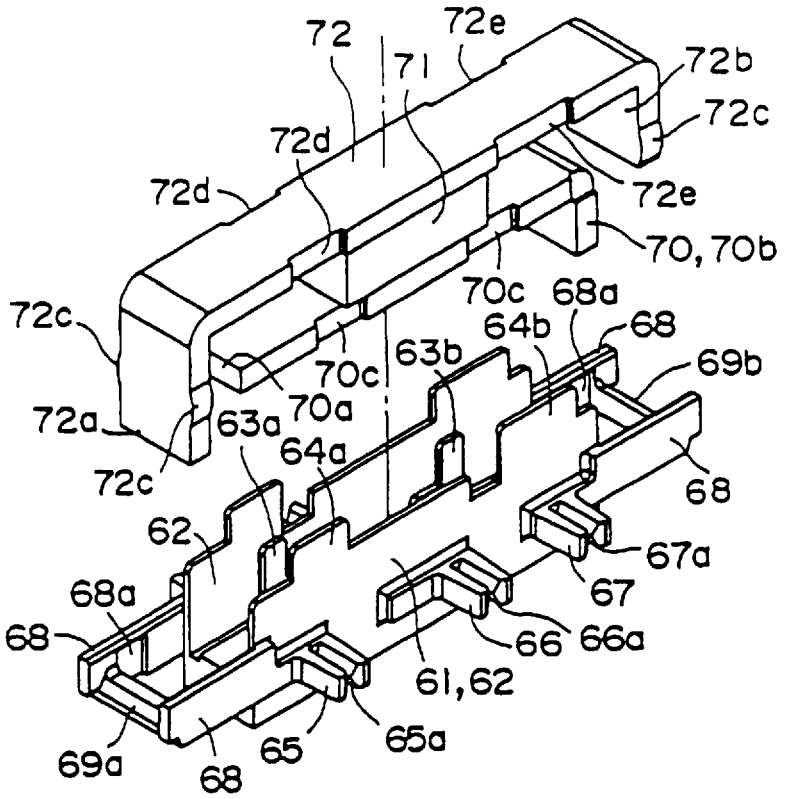
Figure 13A:
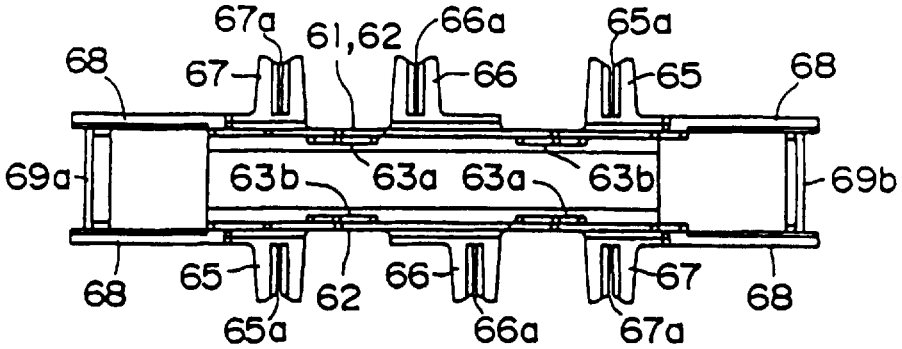
Figure 13B:
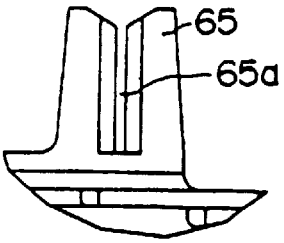
Figure 13C:
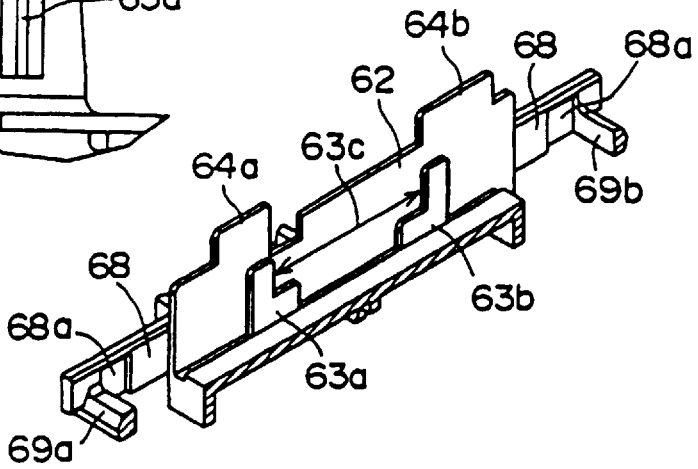
Figure 13D:
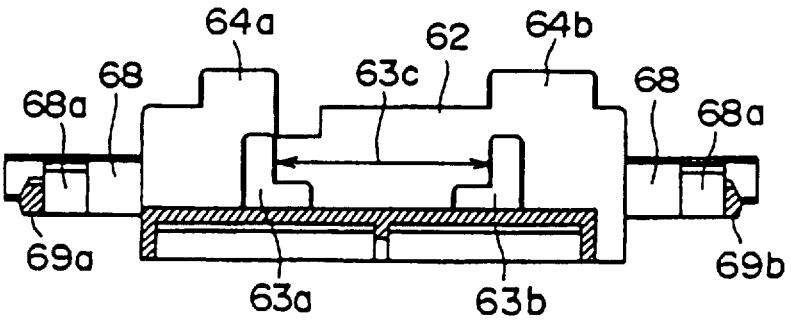

FIG. 12 is an exploded perspective drawing of the movable block.

FIG. 13*a*–*d* show the card for the movable block. (a) is a planar view. (b) is a magnified view of an essential part of the block. (c) is a perspective drawing of a cross section of the block. (d) is a cross section viewed from the front.

Figure 14:
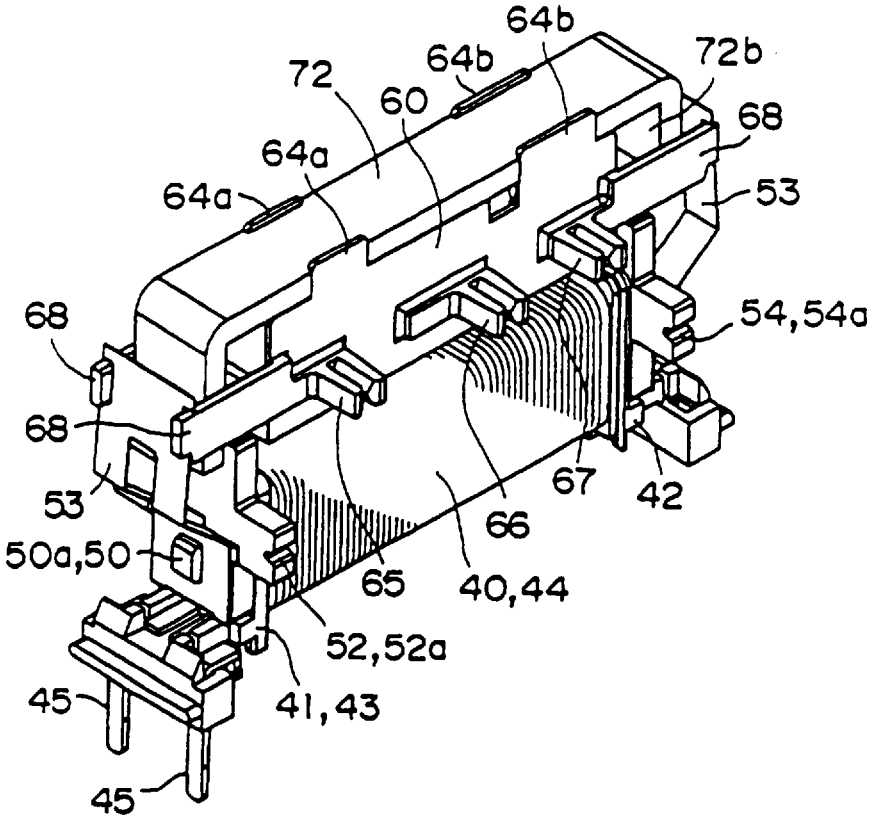

FIG. 14 is a perspective drawing which shows the movable block mounted on the electromagnetic block.

Figure 15A:
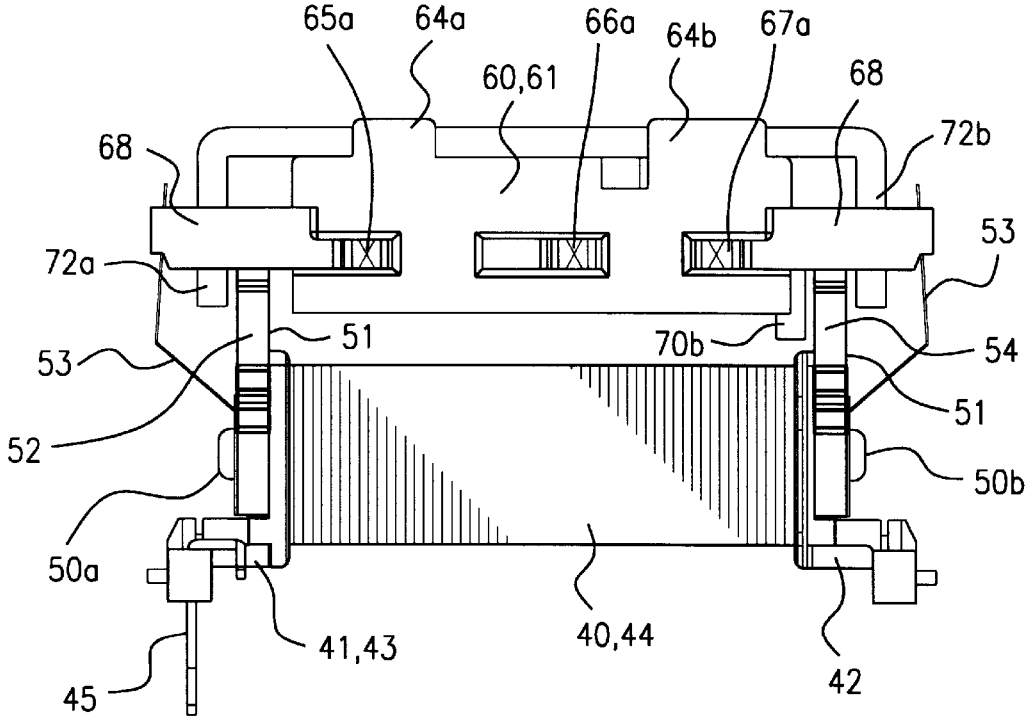
Figure 15B:
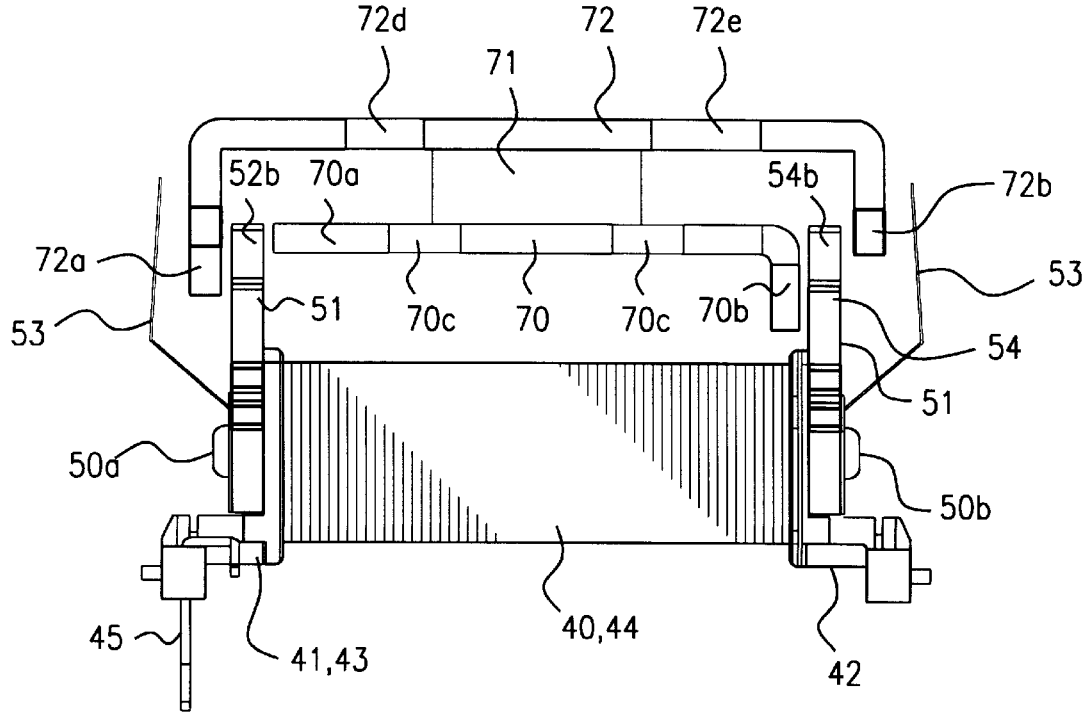
Figure 16:
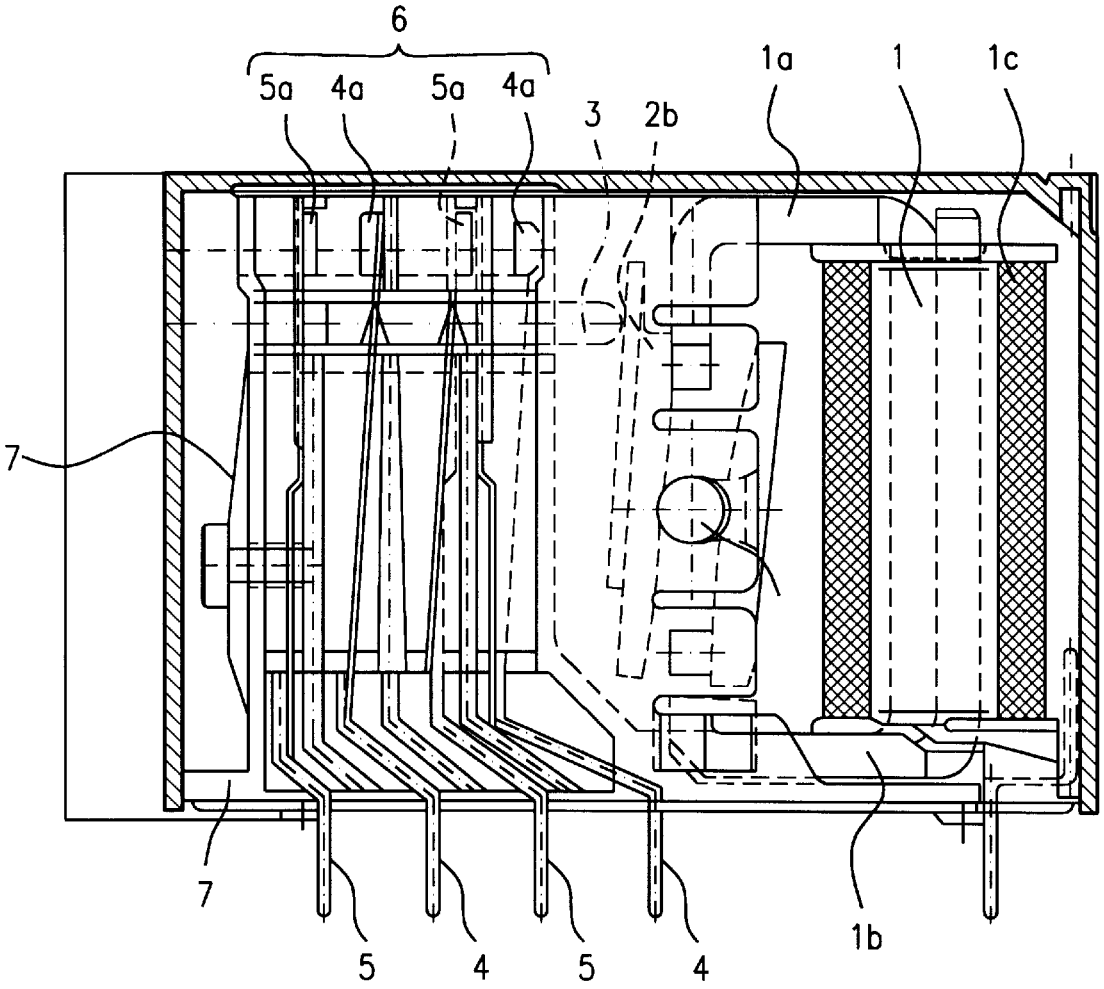

FIG. 15*a*–*b* shows the electromagnetic and movable blocks from FIG. 14. (a) is a frontal view and (b) is a simplified frontal view. FIG. 16 is a cross section of an electromagnetic relay belonging to the prior art, viewed from the front.

DETAILED DESCRIPTION OF THE INVENTION

We shall next discuss an ideal embodiment of this invention with reference to the appended drawings in figures 1 through 15.

Figure 1:
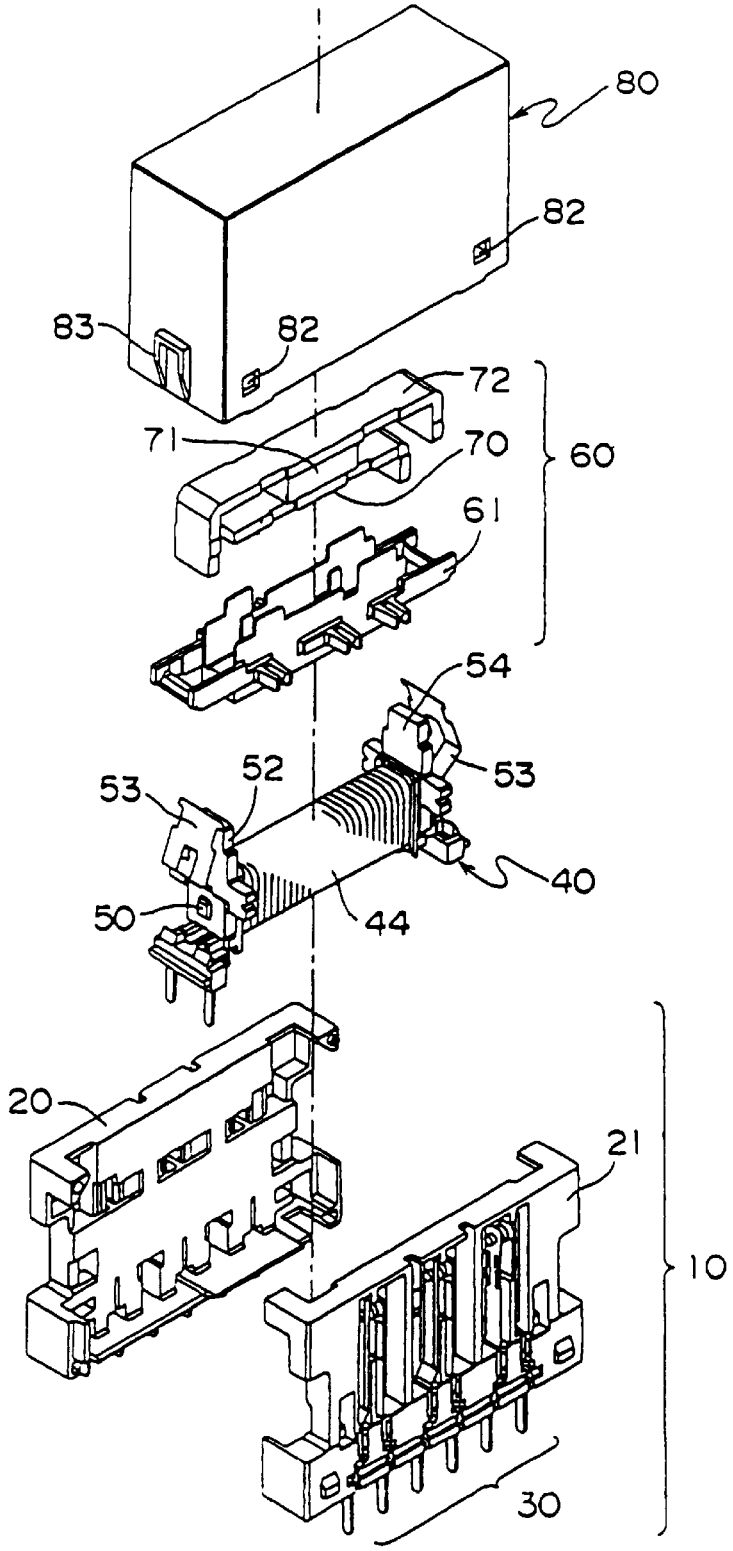
FIG. 1 is an exploded perspective drawing of an electromagnetic relay which is an ideal embodiment of this invention.
Figure 2:
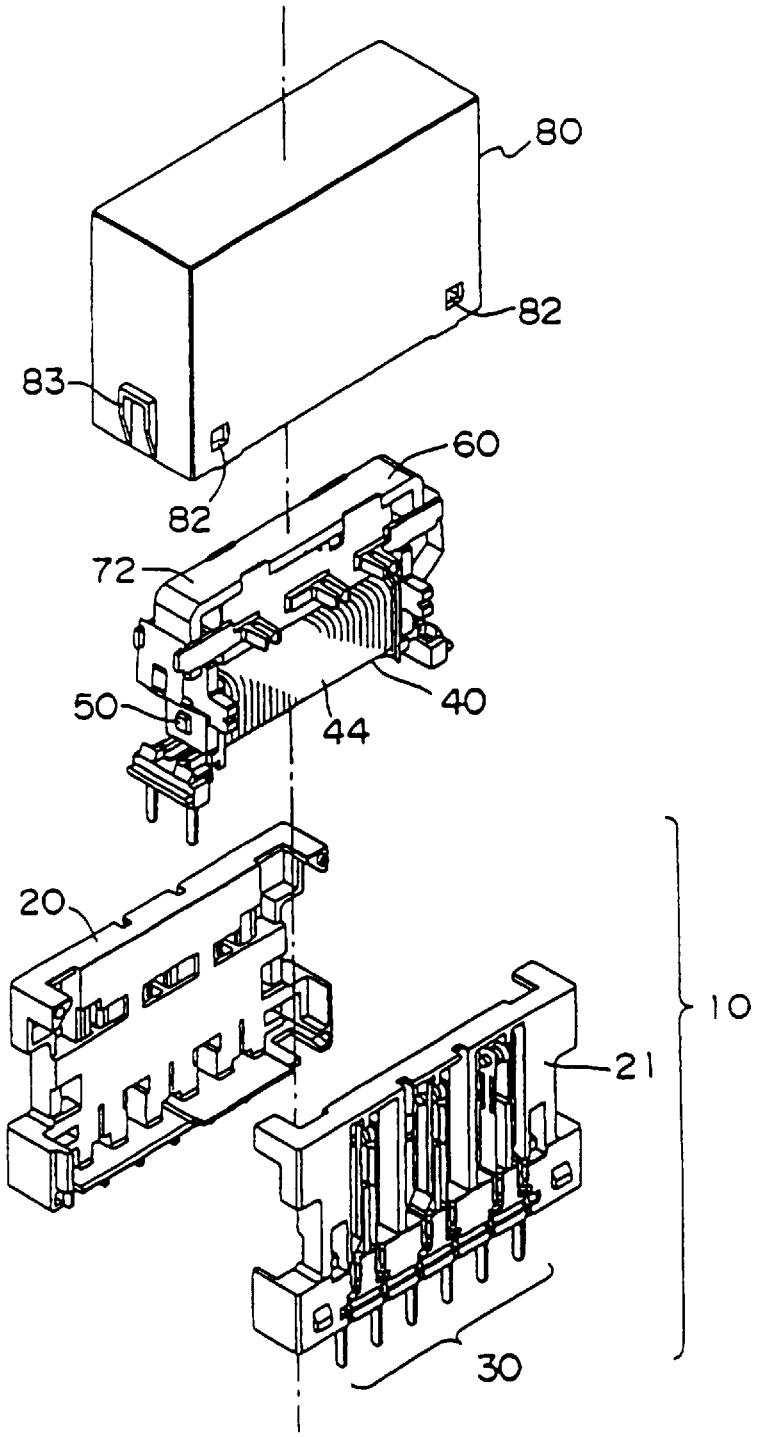
FIG. 2 is an exploded perspective drawing of the relay shown in FIG. 1 when it is partly assembled.
Figure 3:
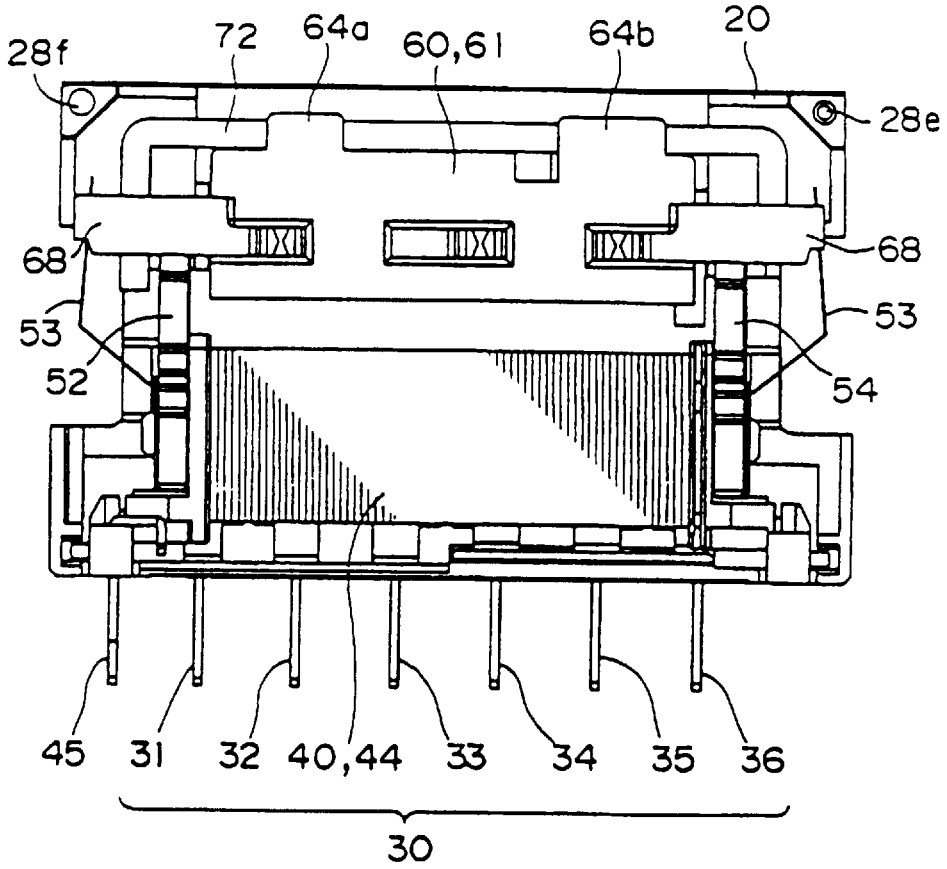
FIG. 3 is a frontal view of the electromagnetic and movable blocks installed in the base.

The electromagnetic relay shown in FIG. 1 is an embodiment of this invention. It comprises primarily of base block 10, electromagnetic block 40, movable block 60 and case cover 80.

Base block 10 is shaped roughly like a box and comprises of two halves, base unit 20 and base unit 21 (See FIG. 6). Contact mechanisms 30 are installed on the exterior surfaces of the aforesaid base units 20 and 21. Since base units 20 and 21 are identical in shape, we shall omit a detailed explanation of base unit 20 for the sake of brevity.

As can be seen in FIGS. 7 and 8, the exterior surface of base unit 21 is divided by partitions 22*a* and 22*b* into three parallel niches, 23*a*, 23*b* and 23*c*. Drive rods 65, 66 and 67 in movable block 60, which is shown in FIG. 12 and will be discussed shortly, extend all the way to the innermost portions of niches 23*a*, 23*b* and 23*c*. Apertures 24*a*, 24*b* and 24*c*, which allow the drive rods to travel back and forth, are cut into the lateral surface of the base unit. At the lower ends of niches 23*a*, 23*b* and 23*c* are three pairs of slits, 25*a* through 25*f*, which communicate with the aforesaid niches 23*a*, 23*b* and 23*c*. Two indentations, 26*a* and 26*b*, are provided on the upper portion of niche 23*b*. Two disconnected positioning ribs, 27*a* and 27*b*, divide each of the aforesaid niches 23*a*, 23*b* and 23*c* down their center lines.

Next to the aforesaid niches 23*a* and 23*c* are two through holes, 28*a* and 28*b*, which are to be used for caulking. On the ends of the aforesaid base unit 21 are cut-away portions 28*c*, which form apertures 11, to be discussed later. In the lower left and right corners of the outer surface of the aforesaid base unit 21 are bosses 28*d*, which engage with the case. In the upper left and right corners of the inner surface of the aforesaid base unit 21, the surface which engages with its counterpart, are peg 28*e* and hole 28*f*.

Terminals 31*a* through 36*a*, on fixed contact elements 31, 33 and 36 and movable contact elements 32, 34 and 35, are pressed into slits 25*a* through 25*f* in base unit 21. In this way fixed contact elements 31, 33 and 36 come in contact with and are held in position by ribs 27*a* and 27*b* on base unit 21; and their fixed contacts, 31*b*, 33*b* and 36*b*, are brought face to face with movable contacts 32*b*, 34*b* and 35*b* so that they can make or break contact with them.

Because the positions of fixed contact elements 31, 33 and 36 are stabilized by the aforesaid ribs 27*a* and 27*b* in this embodiment, the contacts may be separated by force even if contact welding should occur.

Furthermore, the three aforesaid pairs of ribs 27*a* and 27*b* are interposed between fixed contact elements 31, 33 and 36 and their respective movable contact elements 32, 34 and 35. This arrangement improves the isolation characteristic of the relay.

Also, in this embodiment fixed contact elements 31, 33 and 36 and movable contact elements 32, 34 and 35 can be pressed into various positions. This arrangement is convenient in that it allows the user to realize any of a number of different electromagnetic relays with various contact specifications.

Since base units 20 and 21 have the same shape, there are fewer components to manage, a single mold will suffice, and economies can be realized in production costs.

Electromagnetic block 40 is pictured in FIGS. 9 and 10. Coil 44 is wrapped around the central portion of spool 43, which is linearly symmetric. On either end of spool 43 are flanges 41 and 42. The ends of the coil which are drawn out are tied and soldered to coil terminals 45 on flange 41. Core 50 is inserted into center hole 46 of the aforesaid spool 43. Magnetic isolation plate 51, core support 52 and spring 53 are fitted, one after the other, onto one protruding end of the core and caulked in place. Core support 54, magnetic isolation plate 51 and spring 53 are fitted, one after the other, onto the other end of the core and caulked in place.

In this embodiment, then, springs 53 are fixed directly to electromagnetic block 40. This insures that the relay can be assembled with precision so that its operating characteristics will not vary.

Magnetic isolation plate 51 and spring 53 are also secured at the same time that core support 52 is caulked in place. This reduces the number of assembly processes required.

Magnetic isolation plate 51 comprises a thin plate of spring material in which hole 51*a*, which is to be used for caulking, has been punched. Its lower edge is bent at a right angle to form positioning stop 51*b*. Stop 51*b* engages with the lower surface of core support 52 to ensure that this support is mounted securely.

Core supports 52 and 54 have a cross-shaped frontal surface. Arms 52*a* and 54*a*, which are used in the caulking process, project to either side of each support. The upper ends of the respective supports serve as magnetic poles 52*b* and 54*b*. Holes 52*c* and 54*c*, also used for caulking, are in the centers of the lower portions of the two supports.

Support springs 53, which can be seen in FIG. 11, are stamped from a thin spring material which is then bent into shape. When the lower end of the spring is bent upward and folded upon itself, tab 53*b*, which will lock the bottom of the spring in position, projects beyond the lower edge of hole 53*a*, and caulking hole 53*c* is left open. Support springs 53 have two indentations 53*e* on their sides to allow them to engage with the other components.

The aforesaid tab 53*b* comes in contact with the lower edge of hole 53*a*, which is near the line 53*d* marking the angle created by bending the spring. Thus the upper half of each spring 53 rotates on the axis of line 53*d*. There is no possibility that the bearing will slip, and the operating characteristics will remain stable.

Movable block 60, which is shown in FIG. 12, is formed by mounting on card 61, successively, L-shaped movable iron member 70 (first movable member), permanent magnet 71, which has the shape of a rectangular prism, and C-shaped movable iron member 72 (second movable member).

Card 61, which is pictured in FIG. 13, has two parallel side walls 62. On the inner surface of each wall is a pair of L-shaped projections, 63*a* and 63*b*. Tabs 64*a* and 64*b* project from the upper edges of both of the aforesaid walls 62. On the outer surface of each wall 62 are three drive rods, 65, 66 and 67, to drive the aforesaid movable contact elements 32, 34 and 35. Drive rods 65, 66 and 67 have, respectively, slits 65*a*, 66*a* and 67*a*, into which the movable contact elements can be pressed. Arms 68 extend in parallel from the ends of the aforesaid side walls 62. Ridges 69*a* and 69*b*, which traverse the ends of the card, come in contact with the aforesaid support springs 53. Recesses 68*a* face each other on the inner surfaces of the aforesaid arms 68.

A cross section of one of the aforesaid ridges 69*a* and 68*b* would make linear contact with one of the aforesaid support springs 53. The inner edges of ridges 69*a* and 69*b* are equidistant form the center line of card 61. However, the loads on the two support springs 53 will vary when their angles of rotation vary, so the outer edges of ridges 69*a* and 69*b* will be different distances from the center line of card 61.

As shown in FIG. 12, first movable member 70 has two recesses 70*c* on its lateral edges between its two extremities, 70*a* and 70*b*.

Permanent magnet 71 is of a length which allows it to fit in region 63*c* between the aforesaid projections 63*a* and 63*b* as shown in FIGS. 13 (*c*) and (*d*).

Second movable member 72, as shown in FIG. 12, has a projection 72*c* on the lateral surface of each of its ends. Between projections 72*c* it has two indentations, 72*d* and 72*e*, on its lateral surface.

Thus when first movable member 70 is placed from above between side walls 62 on card 60, its recesses 70*c* engage with projections 63*a* and 63*b* on the inner surfaces of walls 62 to lock the member in place with respect to both its length and breadth.

When permanent magnet 71 is fitted into the region between the aforesaid adjacent projections 63*a* and 63*b*, it is also immobilized with respect to its length and breadth.

Projections 72*c* on second movable member 72 engage in recesses 68*a* on card 61. When indentations 72*d* and 72*e* engage with tabs 64*a* and 64*b* on side walls 62, second movable member 72 is immobilized with respect to its length and height. This completes the assembly of movable block 60.

This embodiment offers the advantage that permanent magnet 71 is securely fixed to card 61.

When support springs 53 in electromagnetic block 40 are extended, the ends of arms 68 of movable block 60 engage in recesses 53*e* on the springs. In this way ridges 69*a* and 69*b* on card 61 make contact with the inner surfaces of support springs 53 along a single line, and movable block 60 is supported in such a way that it can travel back and forth parallel to the center line of core 50 (See FIG. 14).

In this embodiment, then, the ends of movable block 60 are supported by two springs 53. This arrangement minimizes the effects of friction and so stabilizes the operating characteristics.

Furthermore, because the ends of block 60 are supported by two springs 53, the aggregate spring force will not vary even if the spring characteristics of individual springs produced in different lots may vary. Thus there will be no variation of operating characteristics due to variations in the precision with which springs 53 were produced.

Once they are assembled as outlined above, electromagnetic block 40 and movable block 60 are mounted on the interior walls of base 20. Movable contact elements 32, 34 and 35 are pressed into slits 65*a*, 66*a* and 67*a* in drive rods 65, 66 and 67 on card 61, which project through windows 24*a*, 24*b* and 24*c* in the base unit.

When the aforesaid pegs 28*e* and holes 28*f* on base units 20 and 21 engage with each other, movable contact elements 32, 34 and 35 are pressed into slits 65*a*, 66*a* and 67*a* in drive rods 65, 66 and 67, which project from windows 24*a*, 24*b* and 24*c* in base unit 21.

When arms 52*a* and 54*a* of core supports 52 and 54, which project from through holes 28*a* and 28*b* in base units 20 and 21 are caulked, base units 20 and 21 are combined into a single unit and base block 10 is completed.

In this embodiment, arms 52*a* and 54*a* are able to travel slightly in the dimension of their length in through holes 28*a* and 28*b*. Thus if the load on the spring varies as a consequence of changing the combination of normally open and normally closed contacts, we can adjust it by sliding the electromagnetic and movable blocks lengthwise with respect to the base block. This arrangement allows us to realize various electromagnetic relays with different contact specifications using the same set of components.

In this embodiment, when cut-away portions 28*c* in base units 20 and 21 are put together, they form aperture 11, which allows support springs 53 on either end of base block 10 to be adjusted. Thus the user can check the operating characteristics before installing cover 80, which will be discussed shortly. If the characteristics are not suitable, he can change them by adjusting support springs 53.

The contacts in contact mechanism 30 are separated by electromagnetic block 40 and movable block 60 with the help of base units 20 and 21. This arrangement insures that the electromagnetic relay will have a superior isolation characteristic.

Case cover 80 has the form of a box which engages with base block 10 to enclose electromagnetic block 40 and movable block 60. It has two parallel ribs, 81*a* and 81*b*, on its interior surface. Even if cover 80 expands outward, ribs 81*a* and 81*b* are still engaged in indentations 26*a* and 26*b* in base units 20 and 21, so they will remain in contact with partitions 22*a* and 22*b*. For this reason the surface distance between niches 23*a*, 23*b* and 23*c* will increase and the isolation characteristic will improve. 82 are anchoring holes, and 83 are the anchors which go through them.

Figure 4:
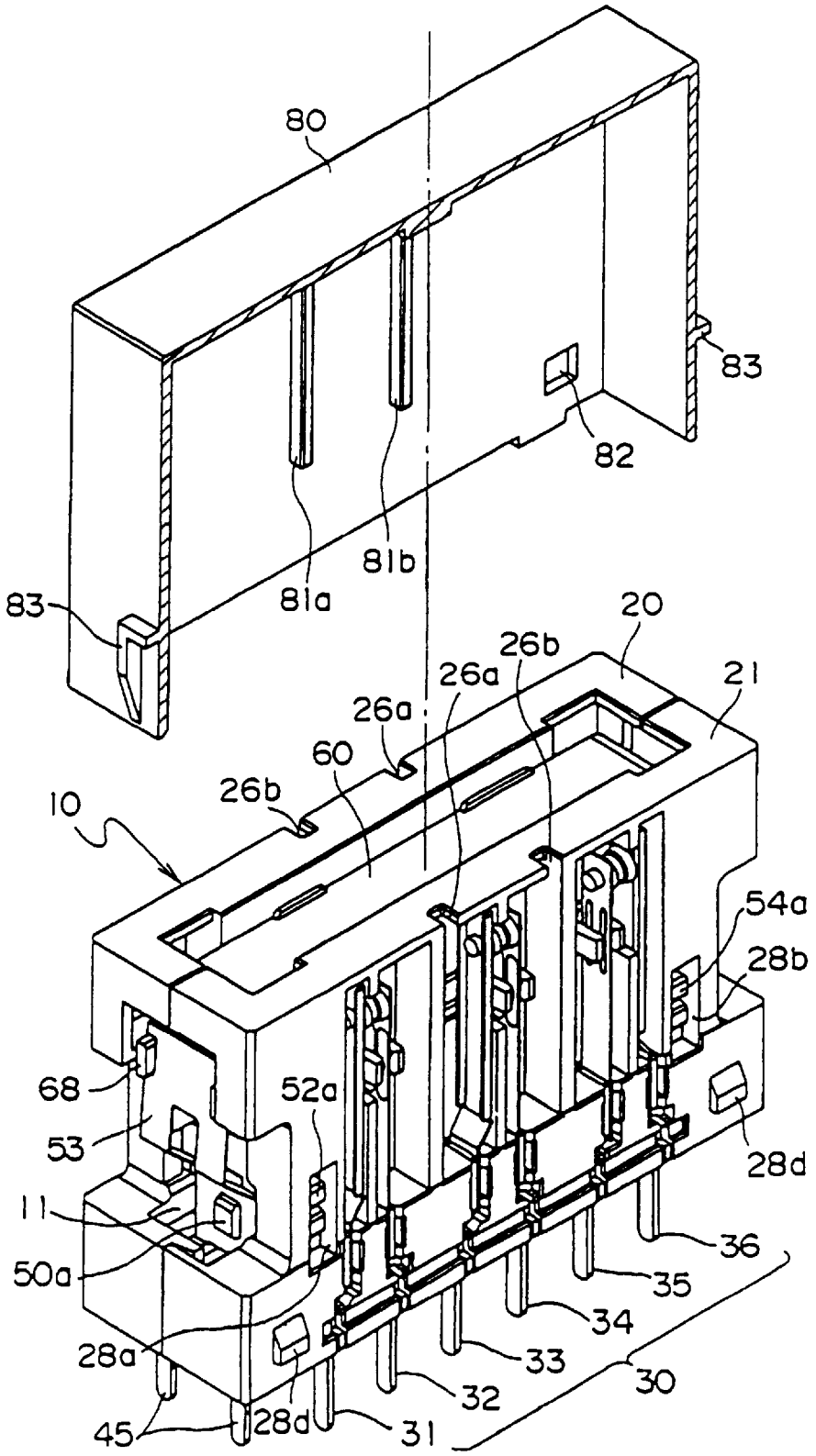
FIG. 4 is a perspective drawing showing how the cover is mounted on the base block.

As can be seen in FIG. 4, ribs 81*a* and 81*b* on cover 80 are pressed into recesses 26*a* and 26*b* in base block 10, which encloses electromagnetic block 40 and movable block 60. Bosses 28*d* on base units 20 and 21 engage in holes 82 in cover 20. At this point the assembly process is completed.

In this embodiment, partitions 22*a* and 22*b* on base units 20 and 21 and cover 80 are interposed between each pair of fixed and movable contact elements in contact mechanism 30. This arrangement insures that the isolation characteristic will be favorable.

We shall next discuss the operation of an electromagnetic relay configured as described above.

First, as can be seen in FIG. 15 (*b*), the opposed surface areas of end segment 70*b* of first movable member 70 and magnetic pole 54*b* of core support 54 are large, as are the opposed surface areas of end segment 72*a* of second movable member 72 and magnetic pole 52*b* of core support 52. This destroys the magnetic balance to left and right.

For this reason, when voltage is not being applied to coil 44 in electromagnetic block 40, end segment 70*b* of first movable member 70 and end segment 72*a* of second movable member 72 are drawn to the aforesaid magnetic poles 54*b* and 52*b* by the magnetic force of permanent magnet 71 in opposition to the spring force of support springs 53.

Figure 5:
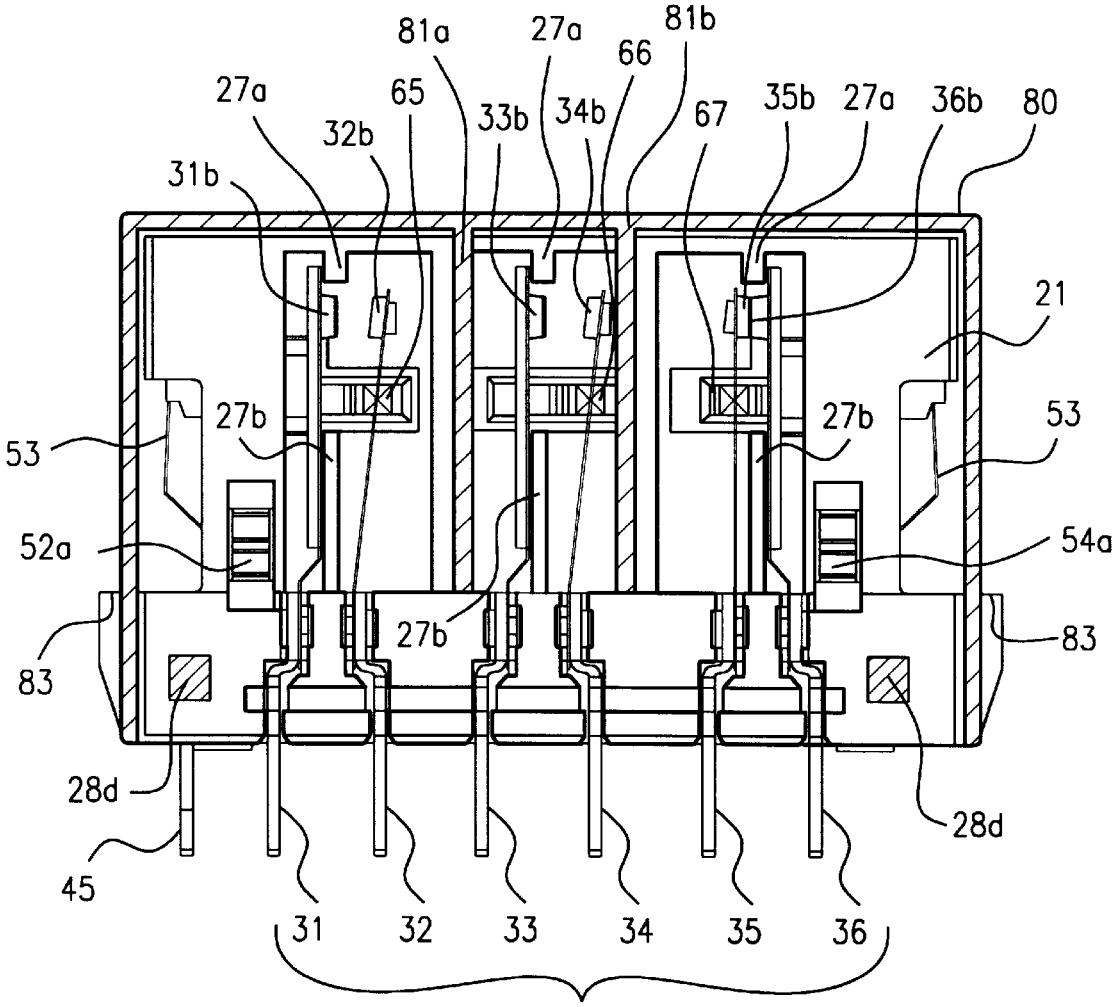
FIG. 5 is a frontal cut-away view of the relay in FIG. 1 when the cover has been installed on the base block enclosing the electromagnetic and movable blocks.

Accordingly, as can be seen in FIG. 5, movable contacts 32*b* and 34*b* on contact elements 32 and 34 separate from fixed contacts 31*b* and 33*b* on elements 31 and 33, and movable contact 35*b* on contact element 35 moves over and touches fixed contact 36*b* on element 36.

When voltage is applied to coil 44 so as to create magnetic flux in a direction which negates the magnetic flux of the aforesaid permanent magnet 71, end segment 70*a* on first movable member 70 is drawn toward magnetic pole 52*b* of core support 52. End segment 72*b* on second movable member 72 is drawn toward magnetic pole 54*b* of core support 54. Thus end segment 70*b* on first movable member 70 separates from pole 54*b* of core support 54, and segment 72*a* on second movable member 72 separates from pole 52*b* of core support 52. As a result, movable block 60 slides toward coil terminals 45 against the magnetic force of magnet 71 and the spring force of springs 53. Movable contact 35*b* separates from fixed contact 36*b*, and movable contacts 32*b* and 34*b* make contact with fixed contacts 31*b* and 33*b*, thus switching all the contacts. Segment 70*a* on first movable member 70 is drawn to magnetic pole 52*b* of core support 52, and segment 72*b* on second movable member 72 is drawn to pole 54*b* of core support 54.

When this excitation is removed, the spring force of support springs 53 and the magnetic force of permanent magnet 71 cause movable block 60 to slide in the opposite direction and return to its original state.

With this embodiment we have been discussing a relay in which the contacts automatically return to their original state. However, by choosing an appropriate spring force for the movable contacts and the support springs and an appropriate magnetic force for the permanent magnet, we could apply the invention in an electromagnetic relay which automatically maintained itself in the switched state.

As should be clear from the previous discussion, the electromagnetic relay disclosed in claim 1 of this application has a movable block which fulfills the same function as the H electrode and the transmission mechanism in the example of the prior art. This invention, then, requires fewer components. Fewer production processes are required, and no variation will occur in the precision with which the parts are assembled or the operating characteristics, as was the case with prior art relays.

Because the contact mechanism is driven directly by means of the movable block, energy loss is minimized and the energy efficiency of the relay is excellent.

The arrangement chosen, whereby the movable block sits atop the electromagnetic block and the contact mechanisms are placed to either side of the electromagnetic block, allows us to achieve a shorter relay. Placing the contact mechanisms on both sides of the electromagnetic block gives the result that the length of the relay does not increase directly with the number of contacts or the length of the contact mechanism, as in prior art relays.

With the invention disclosed in claim 2, the contact mechanism is partitioned by the electromagnetic block and the movable block with the help of the base. This arrangement allows us to achieve an electromagnetic relay with a superior isolation characteristic.

The box-shaped base block is formed from two base units. As a result, the mold used to form the aforesaid base has a simpler configuration than would be required to form an entire box-type base block and is easier to construct.

With the invention disclosed in claim 3, there is no need to stock two types of base units. This simplifies parts control and allows us to employ a single mold to form the base.

With the invention disclosed in claim 4, the position of the electromagnetic block and the movable block can be adjusted by sliding them along the axial direction of the core. This changes the operating characteristics of the contact mechanism. Thus even if the load on the springs is altered when the combination of movable and fixed contact elements in the mechanism is changed, that load can be adjusted. Thus contact mechanisms with various specifications can be driven by the same electromagnetic block. Since the same components can be put to use for multiple purposes, parts control is simplified.

With the invention disclosed in claim 5, the contact mechanism surrounded by the base on which the cover has been installed has a partition between each pair of movable and fixed contact elements. This design results in a contact mechanism with a superior isolation characteristic.

With the invention disclosed in claim 6, the ribs on the cover make contact with the partitions on the aforesaid base. This has the effect of creating a longer surface between the neighboring pairs of contact elements already isolated by the base partitions, which further enhances the isolation characteristic of the relay.

In the electromagnetic relay disclosed in claim 7, a movable block is installed on a card as one piece with a movable iron member. This movable block travels back and forth with its member in response to the presence or absence of excitation in the electromagnetic block, thus driving the contact mechanism. This arrangement eliminates variation in the precision with which the parts are assembled and the precision with which the relay operates. Also, the response characteristic is superior to that of prior art relays.

In the electromagnetic relay disclosed in claim 8, the movable block is polarized to make it easier to achieve an electromagnetic relay with the desired operating specifications.

In the electromagnetic relays disclosed in claims 9, 10 and 11, the two movable iron members and the permanent magnet can be mounted on the card easily and with a high degree of precision.

In the electromagnetic relay disclosed in claim 12, support springs engage with both ends of the movable block. This allows the block to be supported in such a way that it can travel back and forth. With this arrangement, the aggregate spring force will not vary even if the spring characteristics of two springs produced in different lots does vary. Thus there will be no variation of operating characteristics due to variations in the precision with which the springs were produced.

In the electromagnetic relay disclosed in claim 13, changing the shape of a cross section of the ridges on the card which come in contact with the support springs will adjust the angle of rotation of the springs and their force. This increases the freedom inherent in the design.

What is claimed is:

1. An electromagnetic relay, comprising:

an electromagnetic block comprising a coil wound around a core;

a movable block having contact with said electromagnetic block, said movable block placed on top of said electromagnetic block and having an iron member which moves back and forth parallel to said core in response to a magnetization and demagnetization of said electromagnetic block; and a contact mechanism having a fixed contact and a movable contact driven by a movement of said movable block, said contact mechanism installed on a side of said electromagnetic block.

2. An electromagnetic relay according to claim 1, further comprising a box-shaped base block enclosing both said electromagnetic block and said movable block such that said contact mechanism is mounted on a side of said box-shaped base block.

3. An electromagnetic relay according to claim 2, wherein said box shaped base block comprises a pair of blocks having same shape.

4. An electromagnetic relay according to claim 2, wherein said electromagnetic block and said movable block are adjustable along an axial direction of said iron core in order to adjust an operating characteristics of said contact mechanism.

5. An electromagnetic relay according to claim 2, further comprising a base unit having a partition to separate a first set of two contact elements for said fixed contact and said movable contact from a second set of two contact elements.

6. An electromagnetic relay according to claim 5, wherein said base unit further comprising a rib to separate said first and second sets of two contact elements.

7. An electromagnetic relay according to claim 1, wherein said movable block comprises a card having a drive rod for driving said movable contact.

8. An electromagnetic relay according to claim 7, wherein said movable block further comprising:

first and second movable members driven by said magnetization of said electromagnetic block; and a permanent magnet sandwitched between said first and second movable members.

9. An electromagnetic relay according to claim 7, wherein a recess of said first movable member engages with a projection on an internal surface of said card.

10. An electromagnetic relay according to claim 7, wherein said permanent magnet is immobilized between a pair of projections on an internal surface of said card.

11. An electromagnetic relay according to claim 7, wherein said movable block further comprising an indentation of said second movable member engages with a tab on said card.

12. An electromagnetic relay according to claim 7, wherein said movable block further comprising a pair of support springs which engage with ends of said card in such way that said movable block is free to slide back and forth in a parallel direction to an axis of said core in said electromagnetic block.

13. An electromagnetic relay according to claim 12, wherein a distance between a ridge contacting with said support spring and center of said card is different from a distance between another ridge and said center of said card.

* * * * *